US012516897B2

(12) United States Patent
Puha

(10) Patent No.: US 12,516,897 B2
(45) Date of Patent: Jan. 6, 2026

(54) COMPACT STOCK FOR AR-STYLE FIREARMS

(71) Applicant: Eight Holdings LLC, Coeur D'Alene, ID (US)

(72) Inventor: Teodor Puha, Coeur D'Alene, ID (US)

(73) Assignee: Eight Holdings LLC, Coeur D'Alene, ID (US)

( * ) Notice: Subject to any disclaimer, the term of this patent is extended or adjusted under 35 U.S.C. 154(b) by 0 days.

(21) Appl. No.: 19/009,700

(22) Filed: Jan. 3, 2025

(65) Prior Publication Data

US 2025/0146773 A1 May 8, 2025

Related U.S. Application Data

(63) Continuation of application No. 18/120,381, filed on Mar. 11, 2023, now Pat. No. 12,222,178.

(60) Provisional application No. 63/319,896, filed on Mar. 15, 2022.

(51) Int. Cl.

| | |
|---|---|
| ***F41A 3/66*** | (2006.01) |
| ***F41A 3/84*** | (2006.01) |
| ***F41C 23/06*** | (2006.01) |

(52) U.S. Cl.

CPC ..... *F41A 3/66* (2013.01); *F41A 3/84* (2013.01); *F41C 23/06* (2013.01)

(58) Field of Classification Search

USPC ..... 42/74, 1.06, 73

See application file for complete search history.

(56) References Cited

U.S. PATENT DOCUMENTS

| | | | | |
|---|---|---|---|---|
| 1,213,951 | A * | 1/1917 | Ringsmith | F41C 23/08 42/74 |
| 1,307,529 | A * | 6/1919 | Werndl | F41C 23/06 42/74 |
| 8,434,252 | B2 * | 5/2013 | Holmberg | F41A 3/84 42/1.06 |
| 8,516,730 | B2 * | 8/2013 | Valin | F41C 23/08 42/74 |
| 9,395,149 | B2 * | 7/2016 | Balgaard | F41C 23/14 |

(Continued)

OTHER PUBLICATIONS

Int'l Search Report and Written Opinion of the International Searching Authority for PCT/US2023/015171, Jan. 23, 2024.

*Primary Examiner* — Reginald S Tillman, Jr.

(74) *Attorney, Agent, or Firm* — Eric B. Fugett; Mark A. Pitchford; Pitchford Fugett, PLLC

(57) ABSTRACT

A compact stock for an AR-style firearm includes a receiver extension configured to attach to a lower receiver, a buffer assembly receivable in the receiver extension, a buffer biasing member receivable in the receiver extension, and a buffer locking mechanism. The buffer assembly is configured to reciprocate between a retracted position wherein the buffer assembly is contained within the receiver extension, and an extended position wherein the buffer assembly is in-battery within an upper receiver. The buffer biasing member is configured to bias the buffer assembly toward the extended position. The buffer locking mechanism is configured to selectably retain the buffer assembly and the buffer biasing member within the receiver extension when the buffer assembly is in the retracted position such that the upper receiver is rotatable relative to the lower receiver about a forward take down pin of the firearm unimpeded by the buffer assembly and buffer biasing member.

3 Claims, 16 Drawing Sheets

(56) References Cited

U.S. PATENT DOCUMENTS

| | | | | |
|---|---|---|---|---|
| 9,766,034 | B2 * | 9/2017 | Huang | F41C 23/04 |
| 10,088,268 | B2 | 10/2018 | Hewes | |
| 10,156,422 | B1 * | 12/2018 | Valin | F41C 23/20 |
| 10,260,837 | B1 | 4/2019 | McGinty | |
| 10,704,848 | B1 | 7/2020 | Zeider et al. | |
| 10,794,661 | B2 * | 10/2020 | Irvin | F41C 23/04 |
| 11,340,029 | B2 * | 5/2022 | Stenzel | F41A 35/06 |
| 2016/0116249 | A1 * | 4/2016 | Maugham | F41C 23/08 42/74 |
| 2016/0209161 | A1 | 7/2016 | Wilson et al. | |
| 2017/0205190 | A1 | 7/2017 | Jen et al. | |
| 2017/0241737 | A1 * | 8/2017 | Keller, II | F41A 3/66 |
| 2021/0003358 | A1 | 1/2021 | Spuhr | |
| 2021/0222973 | A1 | 7/2021 | Kincel et al. | |

* cited by examiner

COMPACT STOCK FOR AR-STYLE FIREARMS

CROSS-REFERENCES TO RELATED APPLICATIONS

This non-provisional patent application is a continuation of U.S. Non-Provisional patent application Ser. No. 18/120,381, filed Mar. 11, 2023 and titled "COMPACT STOCK FOR AR-STYLE FIREARMS," which claims priority to U.S. Provisional Patent Application No. 63/319,896, filed Mar. 15, 2022 and titled "PDW STOCK," the entire disclosures of each of which are hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of AR-style firearms, and more particularly, to compact stocks for AR-style firearms.

AR-style (i.e., AR-pattern) firearms are well-known. AR-style firearms, such as the AR-15® and AR-10®, are the most popular and widely owned firearms currently in use in the United States. These firearms are famous for their reliability, modularity, and ease of use. AR-style firearms have been chambered to function with a wide variety of ammunition, ranging from .17 to .500 caliber cartridges, as well as 12-gauge, 20-gauge, and .410 bore shotshell cartridges. AR-style firearms generally include a barrel, upper and lower receivers, a bolt assembly, a direct impingement or gas piston operating system to cycle the bolt assembly, a receiver extension (also commonly known as a "buffer tube") connected to the lower receiver, an elongated stock connected to the receiver extension, and a reciprocating buffer disposed in the receiver extension that assists with cycling the bolt assembly.

For example, when an AR-style firearm is fired, propellant gasses generated upon discharge of a cartridge travel through the barrel, into a gas block, back through a gas tube, and directly (in the case of a direct impingement system) or indirectly (in the case of a gas piston system) push the bolt assembly rearward. This causes the bolt assembly to contact the buffer, compressing a buffer spring housed inside the receiver extension and sliding the bolt assembly rearward and partially into the receiver extension. The compressed buffer spring eventually decompresses and pushes the buffer and the bolt assembly forward towards the muzzle end of the firearm. Forward movement of the bolt assembly chambers the next round and makes the gun ready to fire again by returning it to an in-battery position.

Compact or Personal Defense Weapon (PDW) firearms are a class of firearms that are typically lighter and have a smaller profile than a traditional firearm such as an AR style rifle. Compact AR-style firearms are generally used for home defense and personal security applications due to the inherent need to navigate tight quarters. Compact AR-style firearms are typically limited to firing handgun or other relatively low-pressure ammunition, such as 9 mm cartridges or 12-gauge shotshells, due to their size constraints. Compact AR-style firearms capable of firing rifle caliber ammunition exist, but such firearms are generally considered unreliable and insufficiently compact due the extra length required to safely handle relatively higher-pressure rifle caliber ammunition. Often, to reduce the weight and size of the firearm, the overall length of the barrel is shortened, which can negatively impact performance. Further, the decreased dwell time and increased gas pressure caused by the shortened barrel may cause "bolt bounce," which may lead to a misfire or otherwise damage the bolt assembly.

A PDW stock (i.e., a compact stock) is typically a collapsing or telescoping stock that attaches to the lower receiver of an AR-style firearm to form a PDW firearm. PDW stocks are typically used in conjunction with shorter barrels (i.e., barrels shorter than 10.3 inches or approximately 26 cm). Because a standard AR-style receiver extension (i.e., "buffer tube") adds a considerable amount of overall length to the firearm, currently available PDW stock generally include a housing, a shortened atypical receiver extension connected to the housing, a buffer and a buffer spring each partially disposed in the receiver extension and partially disposed in the upper receiver, and a buttstock adjustably mounted to the housing. However, currently available PDW stocks are insufficiently compact, unreliable, and make the firearm to which they are attached notoriously cumbersome to manipulate, especially during assembly or disassembly of the firearm.

Accordingly, what is needed are improvements in compact stocks for AR-style firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide a compact stock for an AR-style firearm, such as a shotgun or a handgun. The compact stock includes a housing, a receiver extension receivable through the housing and threadable into a lower receiver of the firearm to secure the housing to the lower receiver, a buffer assembly configured to reciprocate back and forth between the receiver extension and an upper receiver of the firearm, a biasing member at least partially housed within the receiver extension and configured to bias the buffer assembly toward an extended in-battery position within the upper receiver, and a buffer locking mechanism configured to selectably and mechanically retain the buffer assembly in a retracted position wherein the buffer assembly and buffer biasing member are completely contained within the receiver extension. The buffer locking mechanism prevents the buffer assembly and buffer biasing member from impeding rotational movement of the upper receiver relative to the lower receiver about a forward take down pin of the firearm during assembly or disassembly of the firearm.

Accordingly, in one aspect, there is provided a compact stock for an AR-style firearm comprising a receiver extension configured to attach to a lower receiver of the firearm; a buffer assembly received in the receiver extension and configured to reciprocate between a retracted position wherein the buffer assembly is contained within the receiver extension and an extended position wherein the buffer assembly is in-battery within an upper receiver of the firearm; a buffer biasing member received in the receiver extension, the buffer biasing member configured to bias the buffer assembly toward the extended position; and a buffer locking mechanism configured to selectably retain the buffer assembly and the buffer biasing member within the receiver extension when the buffer assembly is in the retracted position such that the upper receiver is rotatable relative to the lower receiver about a forward take down pin of the firearm unimpeded by the buffer assembly and biasing member.

In another aspect, there is provided a compact stock for an AR-style firearm, comprising a housing configured to be engaged with a lower receiver of the firearm, the housing comprising a longitudinal through hole defining a first mating surface; and a receiver extension configured to be received through the through hole of the housing and to threadingly engage the lower receiver, the receiver extension comprising an annular protrusion defining a second mating surface; wherein the second mating surface matingly engages the first mating surface to axially secure the housing to the lower receiver when the receiver extension is received in the through hole of the housing and threadingly engaged with the lower receiver.

In yet another aspect, there is provided a compact stock for an AR-style firearm comprising a housing configured to be secured to a lower receiver of the firearm; a butt member defining a pair of rod bores therein; a pair of rod biasing members disposed within the pair of rod bores; a pair of rods extending from the housing into the pair of rod bores and against the pair of rod biasing members; and a pair of fasteners configured to connect the pair of rods to the butt member and retain the pair of rods in the pair of rod bores; wherein the pair of rod biasing members are configured to oppose rearward movement of the rods during discharge of the firearm and thereby damp the recoil of the firearm.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
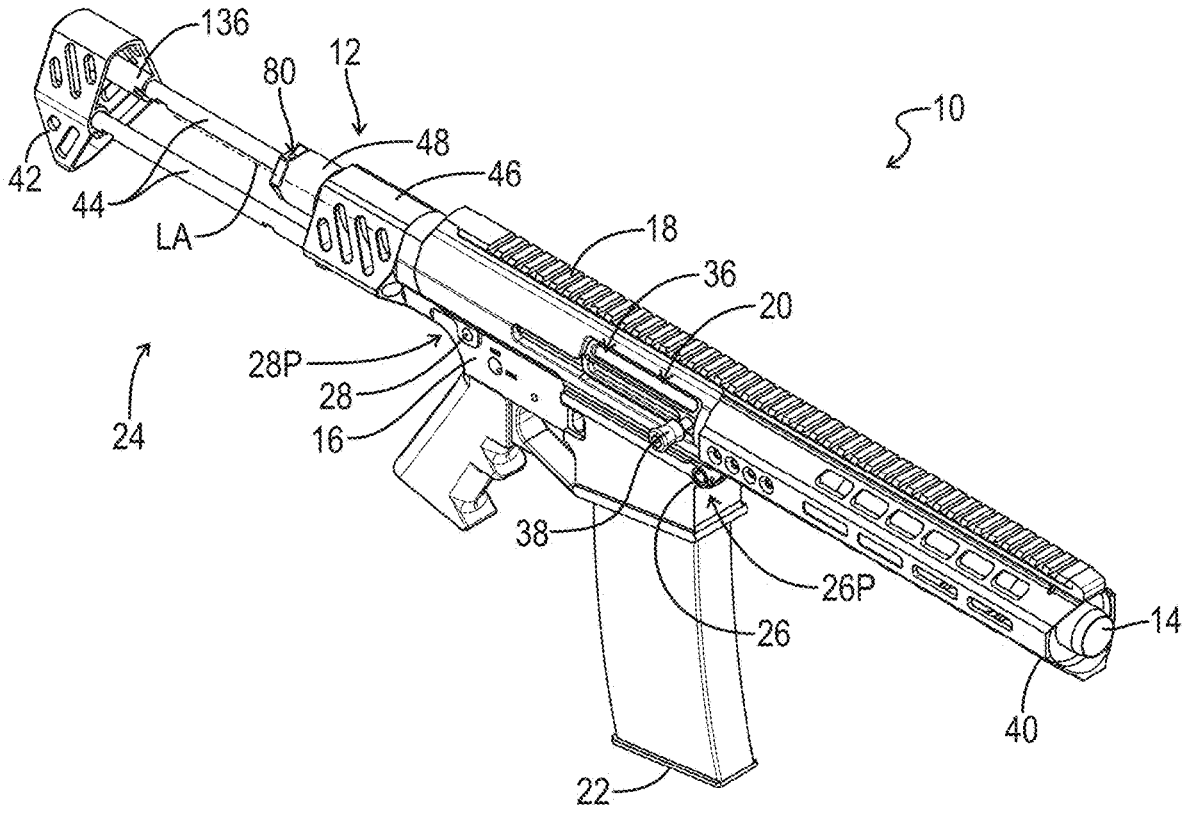
FIG. 1 is an elevated front right side perspective view of an AR-style firearm equipped with a compact stock constructed in accordance with an embodiment of the present invention.

As described herein, an "upright" position is considered to be the position of apparatus components while in proper operation or in a natural resting position as described and shown herein, for example, in FIG. 1. The upright firing position of a firearm is a generally level firing position. As used herein, the terms "aft" and "rear" means in a direction toward a rear end of a firearm, while the terms "front" and "forward" means in a direction extending away from the rear of the firearm toward the muzzle of the firearm. In some cases, the term "forward" can also mean forward beyond the muzzle of the firearm. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring generally to FIGS. 1-14 and 19-20, there is depicted a personal defense weapon in the form of an AR-style firearm 10 equipped with a compact stock 24 (i.e., a PDW stock) constructed in accordance with an embodiment of the present invention. The firearm 10 depicted is configured as a shotgun for firing 12-gauge shotshells, but can be configured to fire other cartridges. The firearm 10 generally includes a barrel 14, a lower receiver 16, an upper receiver 18 detachably connected to the lower receiver 16, a bolt assembly 20, a magazine 22, and the compact stock 24 (discussed in more detail below).

Figure 14:
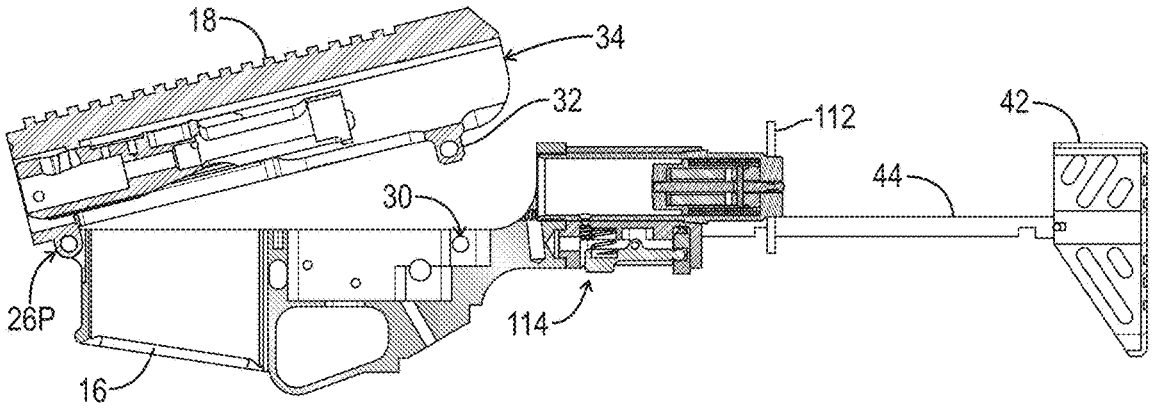
FIG. 14 is a cross-section side view taken along line 14-14 of FIG. 13.
Figure 15:
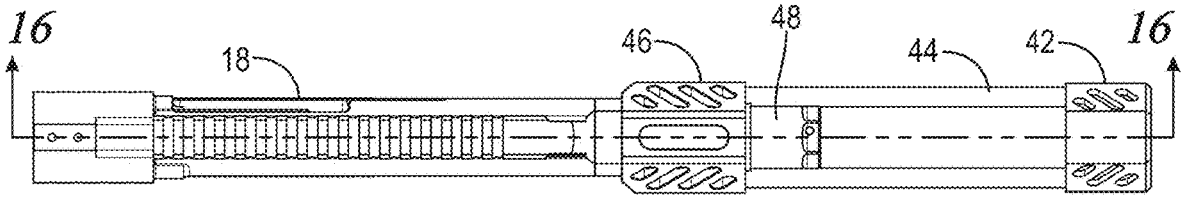
FIG. 15 is a transparent top plan view of an AR-style firearm equipped with a compact stock constructed in accordance with another embodiment of the present invention. The handle, magazine, and barrel of the firearm are omitted for clarity. The buffer assembly is shown in a retracted position. An alternative embodiment of the buffer locking mechanism is shown in an inactive or at-rest position such that it is not engaged with the buffer assembly and is not holding the buffer assembly in the retracted position within the receiver extension.
Figure 16:
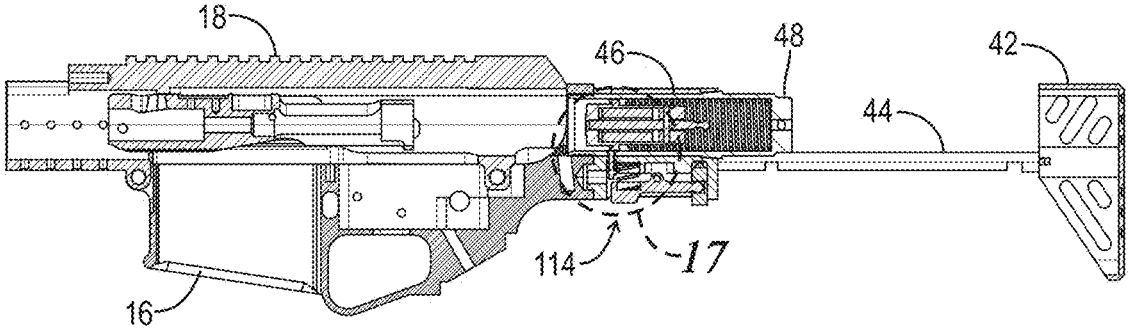
FIG. 16 is a cross-sectional side view taken along line 16-16 of FIG. 15.

The upper receiver 18 is connected to the lower receiver 16 by a forward take down pin 26 at a first, front connection point 26P and a rear take down pin 28 at a second, rear connection point 28P rearward of the first connection point 26P. As best shown in FIG. 14, the lower receiver 16 can have one or more recesses or grooves 30 for receiving one or more protrusions or tabs 32 of the upper receiver 18. The front connection point 26P is located adjacent to the front edge of the lower receiver 16. The rear connection point 28P is located proximate the rear end of the lower receiver 16. The upper receiver 18 is rotatable about the forward take down pin 26 relative to the lower receiver 16 when the rear pin 28 has been removed and the buffer assembly 12 and buffer biasing member 52 are either removed or retracted as described below. Rotation of the upper receiver 18 about the forward take down pin 26 is often desired to access the bolt assembly 20 and required when assembling and disassembling AR-style firearms before and after maintenance or repairs, respectively. The bolt assembly 20 includes a bolt, an extractor 36, and a bolt knob 38. A handguard 40 is secured to the forward end of the upper receiver 18 to protect the hand of a user from heat evolved from the barrel 14. The magazine 22 is received in the lower receiver 16 and supplies cartridges to the firearm 10.

The compact stock 24 generally includes a housing 46, a receiver extension 48, a buffer assembly 12, a buffer biasing member 52, a buffer locking mechanism 54, a butt member 42, a pair of buttstock rods 44, a pair of fasteners 132, and a pair of rod biasing members 134. The housing 46 is configured to be attached to a rear end of the lower receiver 16 via the receiver extension 48, as described in more detail below, such that the receiver extension 48 extends through the housing 46. The housing 46 defines a pair of rod bores 56 in which the rods 44 are axially receivable to mount the rods 44 to the housing 46. The rods 44 include a plurality of spaced pairs of notches (unnumbered) defined therein. A selectably releasable spring-loaded latch 124 mechanism pivotably connected to the housing 46 is biased to engage a pair of notches in the rods 44 and thereby secure the rods to the housing 46. The rods 44 in turn mount the butt member 42 to the housing 46. Each pair of notches along the parallel rods 44 define a different position in which the butt member 42 can be fixed relative to the housing 46, such that the compact stock 24 is retractable and extendable. Activating the latch 124 mechanism allows repositioning of the butt member 42 relative to the housing 46.

The receiver extension 48 includes a buffer bore 72 for receiving the buffer assembly 12 therein. The exterior surface of the front end of the receiver extension 48 is threaded to be threadingly engaged with a threaded aperture 63 in an upwardly extending lobe 64 (i.e., stock mount) of the lower receiver 16. The receiver extension 48 may comprise any desired material, such as metal or polymer. The buffer assembly 12 and buffer biasing member 52 are at least partially housed in the receiver extension 48. The buffer assembly 12 is configured to reciprocate between a retracted position (see, e.g., FIGS. 6 and 11) wherein the buffer assembly 12 is completely contained within the receiver extension 48, and an extended position (see, e.g., FIG. 5A) wherein the buffer assembly 12 is in-battery within the upper receiver 18 of the firearm 10.

Figure 17:
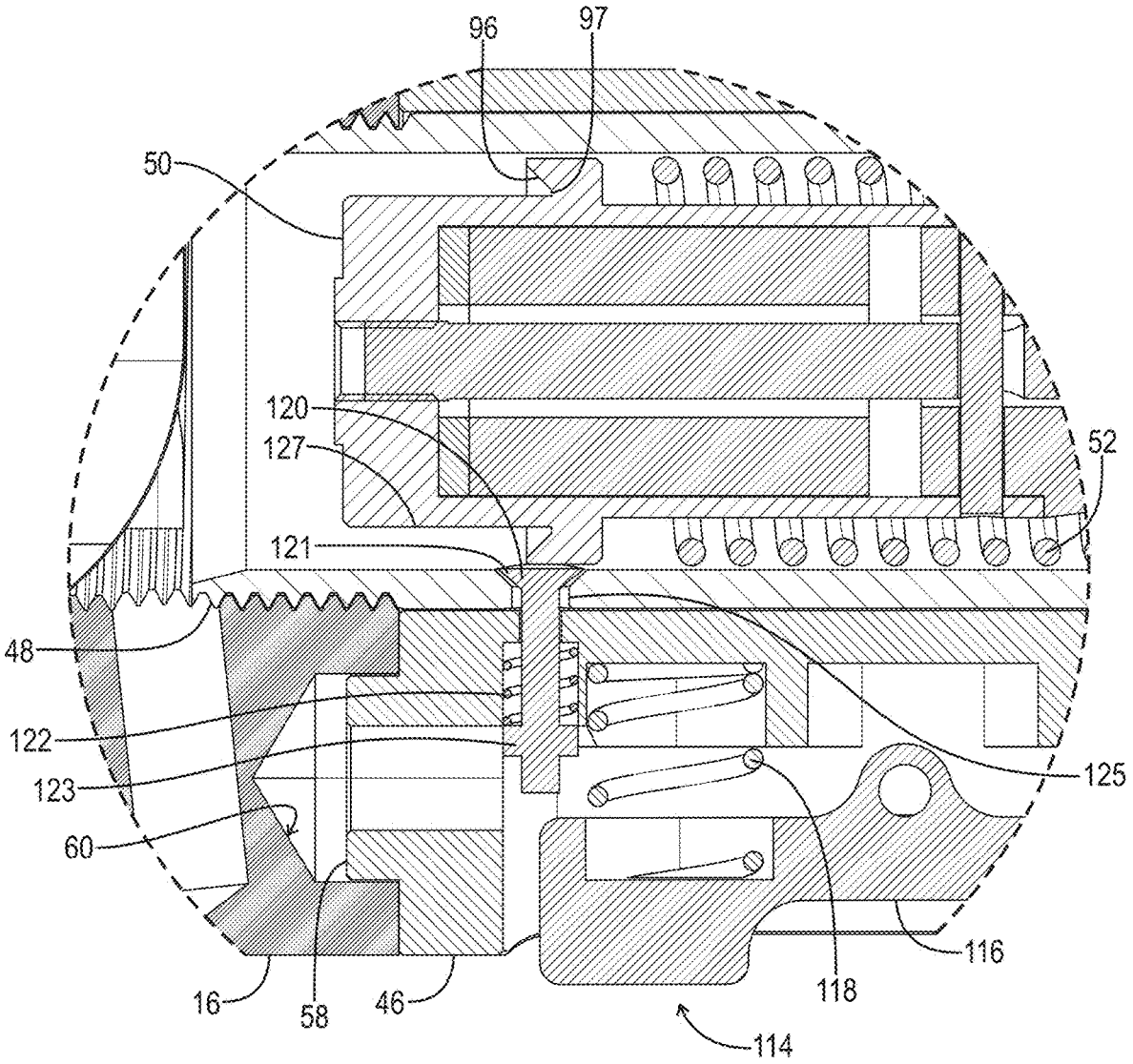
FIG. 17 is an enlarged detail view of the area indicated by circle 17-17 of FIG. 16, more clearly showing a left side sectional view the alternative embodiment buffer locking mechanism in the inactive or at-rest position.
Figure 18:
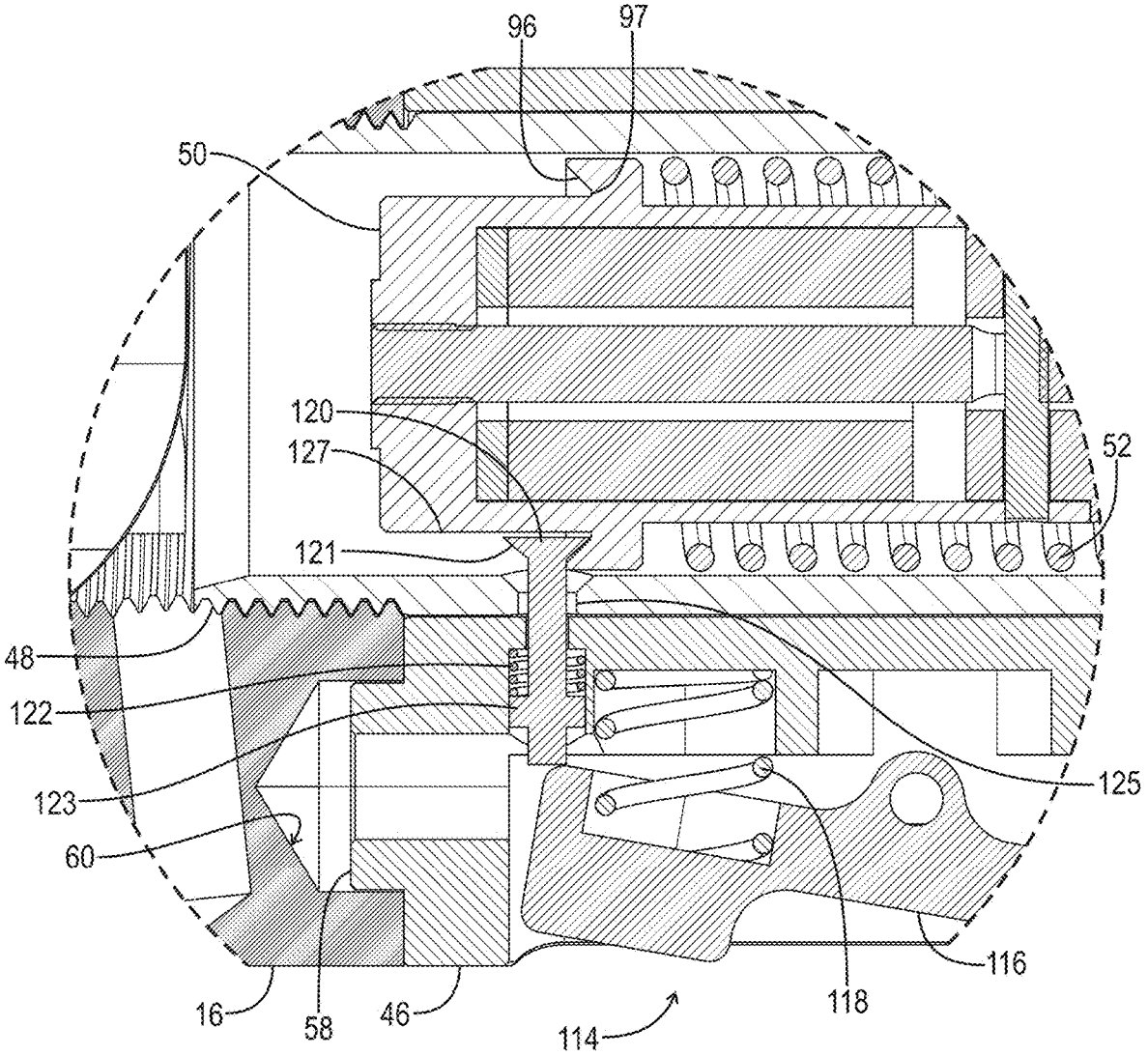
FIG. 18 is another detail view of the buffer locking mechanism of FIG. 17 shown in its activated or working position such that the buffer assembly is secured in the retracted position and contained entirely within the receiver extension.
Figure 19:
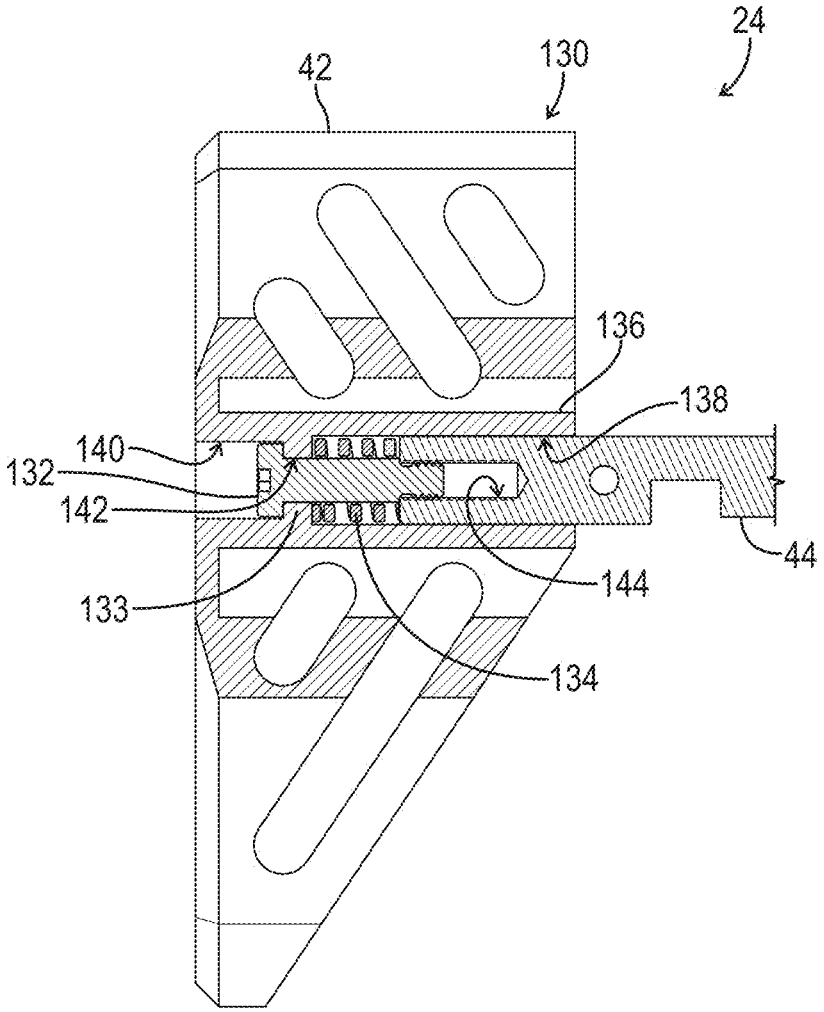
FIG. 19 is a right-side vertical cross-sectional view of the butt portion of the compact stock of FIG. 1 taken along a longitudinal axis of the right-side buttstock rod, showing an embodiment of a recoil damping system in an inactive or at-rest (uncompressed) position.
Figure 20:
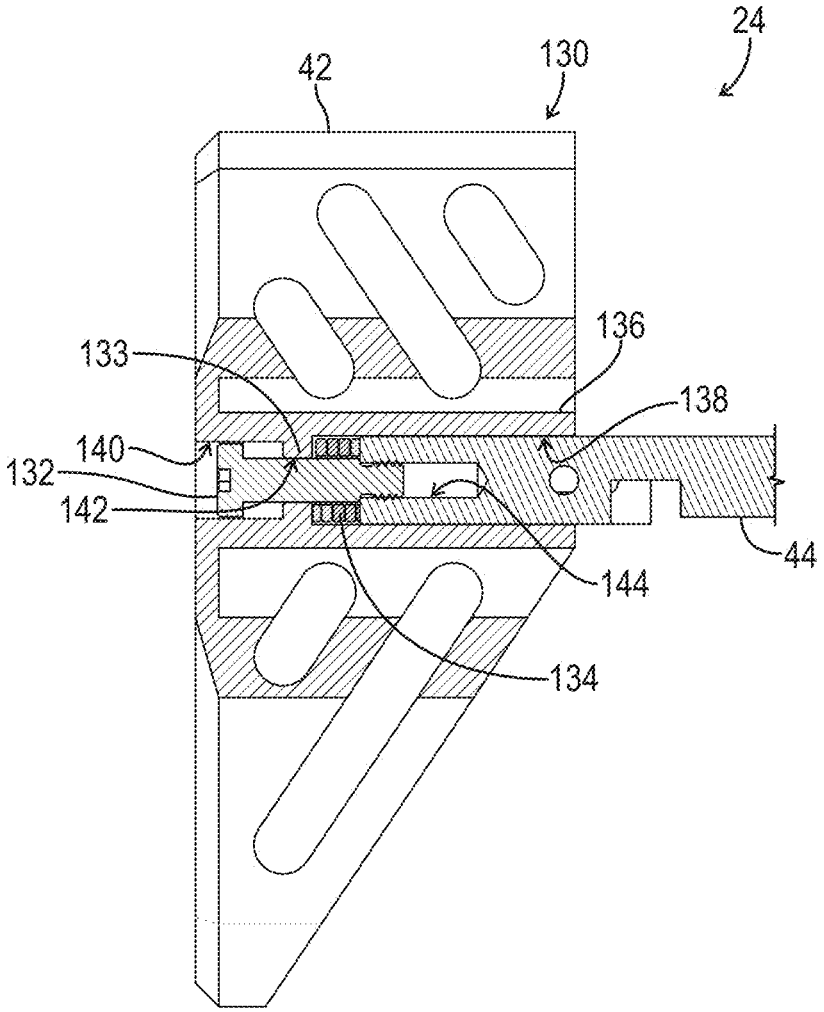
FIG. 20 is another cross-sectional view of the compact stock FIG. 19, showing the recoil damping system in an active or working (compressed) position.

A front end of the housing 46 is configured to mate with the rear end with the lower receiver 16. The housing 46 defines a male mating feature 58 at its front end, facing the lower receiver 16, for mating with a corresponding female mating feature or recess 60 on the lower receiver 16 (see FIG. 17). The male mating feature 58 is in the form of a protrusion 58 that extends longitudinally forward from the front end of the housing 46. When assembled, the protrusion 58 engages and fits within the corresponding recess 60 in the lower receiver 16, which prevents a rotational movement of the housing 46 relative to the lower receiver 16 about a longitudinal axis of the receiver extension LA. The protrusion 58 can have any desired shape and size, and the recess 60 can have a complimentary or corresponding shape and size. For instance, the protrusion 58 can have a circular cross-section and the recess 60 can have a complimentary or corresponding circular cross section in which the circular protrusion 58 is receivable. The housing 46 may comprise any desired material, such as metal or plastic.

Figure 2:
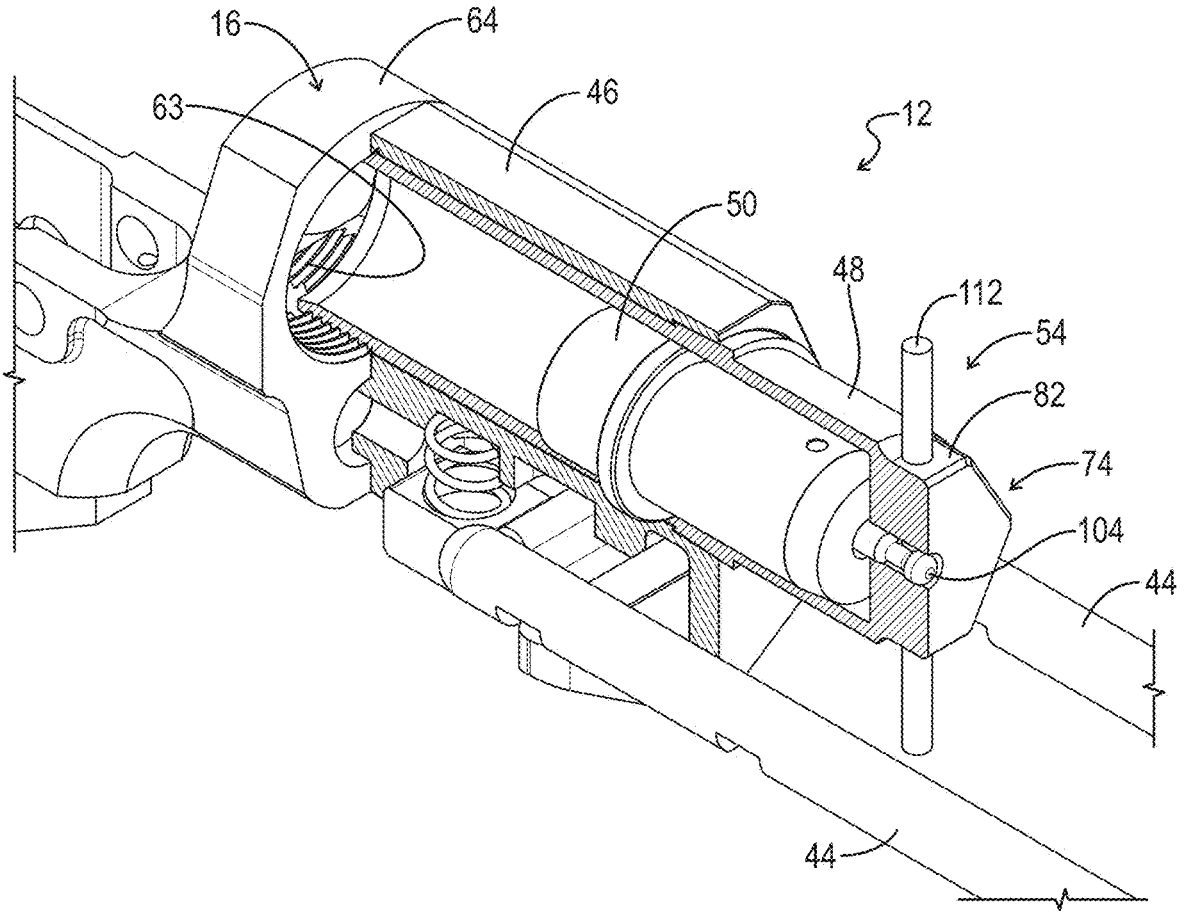
FIG. 2 is an elevated rear left side transparent perspective view of a portion of the firearm and stock of FIG. 1 showing the buffer assembly secured in a retained position within the receiver extension. The upper receiver is omitted.
Figure 3:
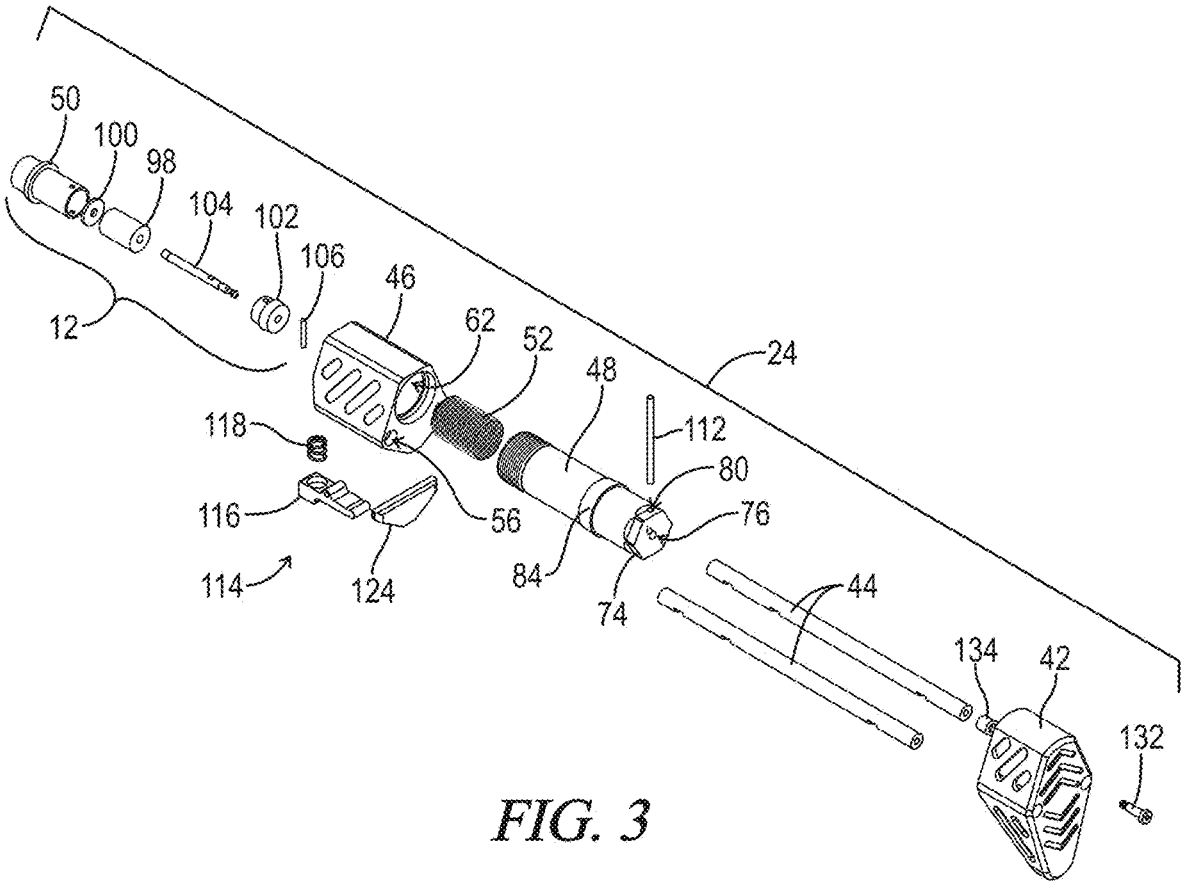
FIG. 3 is an exploded view of the compact stock of FIG. 1.
Figure 4A:
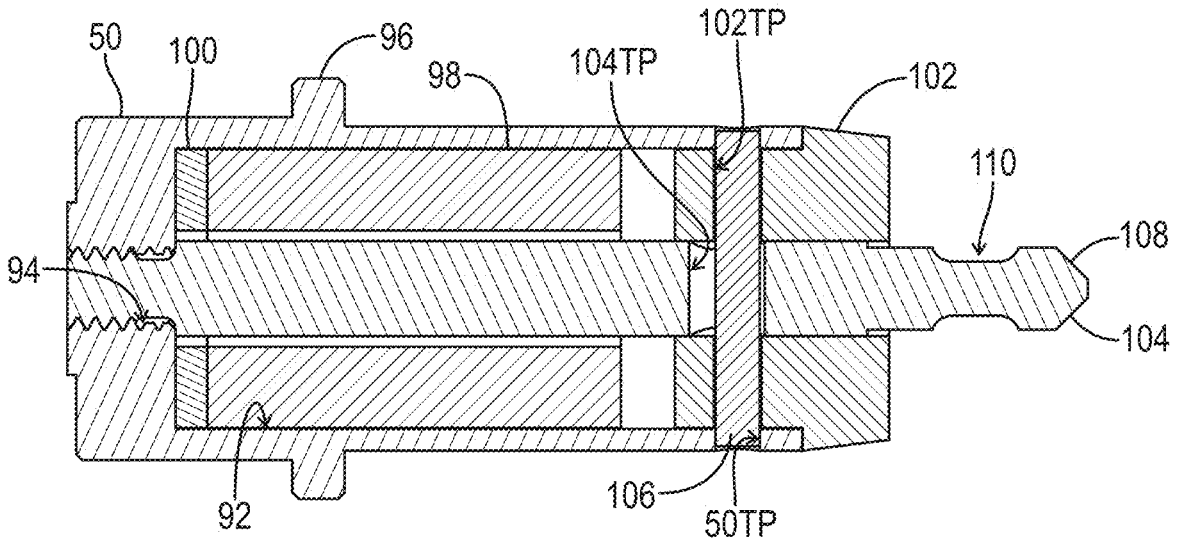
FIG. 4A is a vertical cross-sectional view of the buffer assembly of the compact stock of FIG. 1 taken along its longitudinal axis. The buffer assembly is shown in isolation and assembled with the buffer rod fully threaded into the buffer body.
Figure 4B:
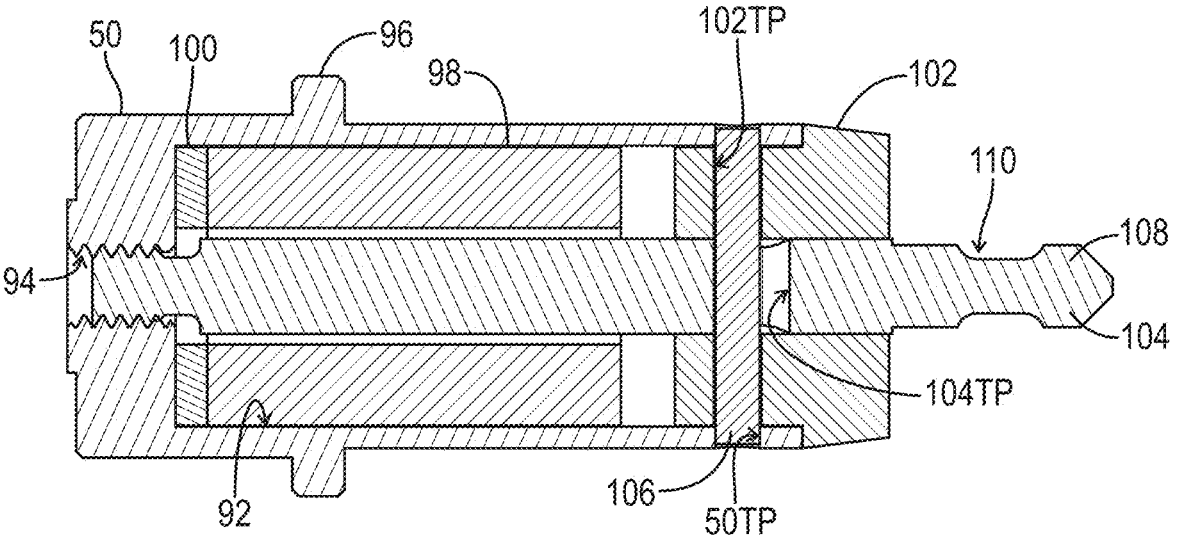
FIG. 4B is another cross-sectional view of the buffer assembly of FIG. 4A showing the buffer assembly with the buffer rod partially threaded into the buffer body.

As best shown in FIGS. 2-3, the housing 46 defines a longitudinal through hole 62 through which the receiver extension 48 is receivable to secure the housing to the lower receiver 16. The through hole 62 has a front opening and a rear opening opposite the front opening. A rear portion 74 of the receiver extension 48 extends rearwardly out of the rear opening of the through hole 62 at the rear end of the housing 46. The rear portion 74 of the receiver extension 48 is configured as a hex head so as to allow a user to engage the head with a corresponding tool (e.g., a wrench) in order to more easily thread the forward end of the receiver extension 48 into the threaded aperture 63 of the lower receiver 16.

The through hole 62 can have a uniform or non-uniform surface profile such that the diameters of its openings can be the same or differ. For instance, the rear opening of the through hole 62 may have a diameter that is greater than the diameter of the front opening. The diameter of the front opening of the through hole 62 can substantially match the diameter of a threaded aperture 63 in the upwardly extending lobe 64 at the rear end of the lower receiver 16, and the diameter of the rear opening of the through hole 62 can correspond to the outer diameter of the receiver extension 48.

Receiver Extension Locking Mechanism

Figure 12:
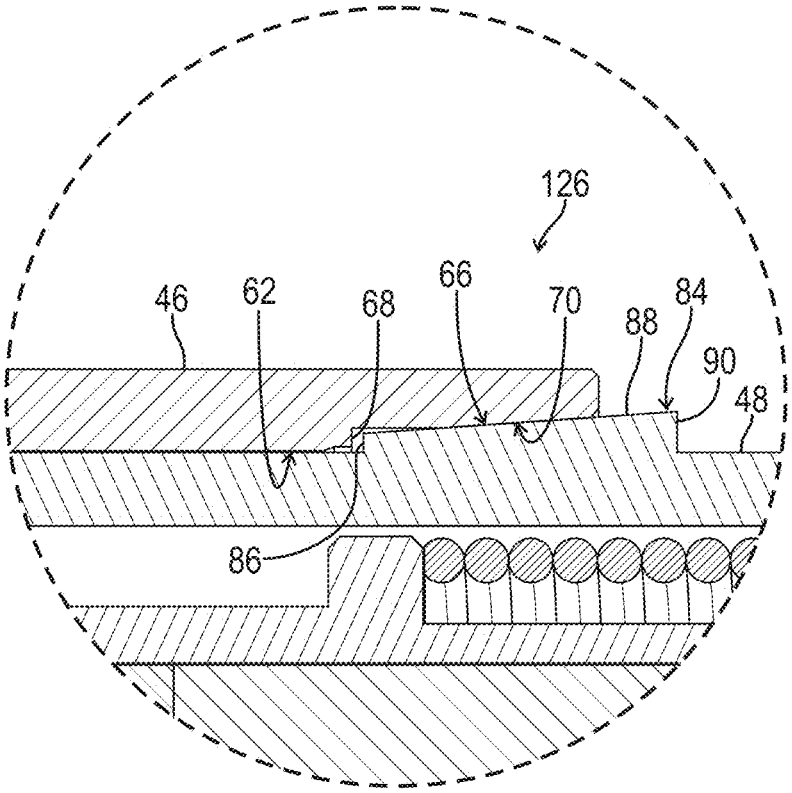
FIG. 12 is an enlarged detail view of the area indicated by circle 12-12 in FIG. 11, showing a left side sectional view of the receive extension locking mechanism of the compact stock.
Figure 13:
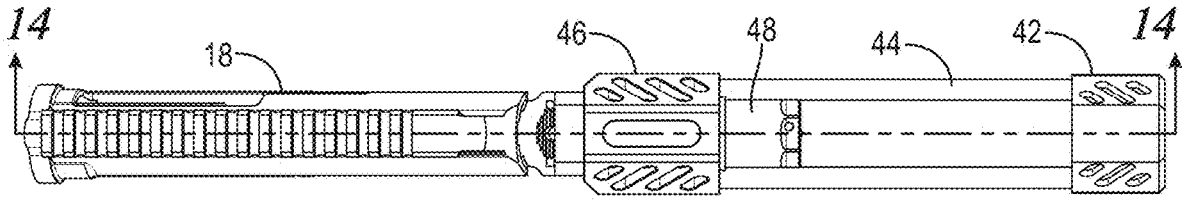
FIG. 13 is a top view of the firearm of FIG. 6, showing the upper receiver pivoted forward and upwardly away from the lower receiver about the forward take down pin while the buffer assembly and buffer biasing member are secured in the retracted position within the receiver extension.

Referring now to FIGS. 2 and 12, the compact stock 24 includes a novel receiver extension locking mechanism 126. The receiver extension locking mechanism 126 secures the housing 46 to the lower receiver 16 of the firearm 10 and prevents the receiver extension 48 from inadvertently backing out of the threaded aperture 63 in lobe 64 of the lower receiver 16 during normal use and operation of the firearm 10. The receiver extension locking system 126 includes features on the housing 46 and the receiver extension 48, which can be integrally formed thereon or attached thereto.

The receiver extension locking system 126 includes a pair of mating surfaces 70, 88 respectively located on the housing 46 and the receiver extension 48. The mating surfaces 70, 88 matingly engage with one another when the receiver extension is received through the through hole 62 of the housing 46 and threaded into the threaded hole 63 of the lower receiver 16. Mating engagement of surfaces 70, 88 applies axial pressure to the rear of the housing 46, thereby securing the housing 46 to the lower receiver 16. Mating engagement of mating surfaces 70, 88 also simultaneously secures the receiver extension 48 to the housing 46 and prevents the receiver extension 48 (and by extension, the housing) from becoming detached from the lower receiver 16. The mating surfaces 70, 88 can be tapered and have a substantially matching or complimentary slope or taper. By "substantially matching" it is meant that the slope or taper of each surface 70, 88 is such that sufficient friction is created between surfaces 70, 88 when they are matingly engaged to maintain mating engagement of the surfaces during normal use and operation of the firearm. The taper can be a 5-degree or less taper. In one embodiment, the taper is a four-degree taper.

In the depicted embodiment, the receiver extension 48 includes an annular protrusion 84 extending radially outward from the exterior surface of the receiver extension 48. The annular protrusion 84 is in the form of a conical frustum which has a flat front face 86, an angled side face 88, and a flat rear face 90. The mating surface 88 of the receiver extension 48 includes at least a portion of the angled side face 88. Similarly, the housing 46 includes a tapered mating section 66 adjacent the rear opening of the through hole 62. The tapered mating section 66 defines a flat end wall 68 and an angled side wall 70 that extends from the flat end wall 68 to the rear opening of the through hole 62. The mating surface 70 of the housing 46 includes at least a portion of the angled side wall 70.

In some embodiments, more than one portion of the annular protrusion 84, such as the front face 86 and angled side wall 88, can engage with more than one portion of the tapered mating section 66 of the through hole 62 in the housing 46. For example, in some embodiments, the front face 86 of the annular protrusion 84 can contact the flat end wall 68 of tapered mating section 66 after the angled side wall 88 of the annular protrusion 84 contacts the angled side wall 70 of the mating section 66. In this way, the end wall 68 inside the housing 46 serves as a positive stop that contacts the front face 86 of the annular protrusion 84 and thereby prevents a user from over-tightening the receiver extension 48 in the lower receiver lobe 64. Overtightening the receiver extension 48 is disadvantageous because it can damage components of the firearm 10 or the compact stock 24 (such as the housing), prevent proper functioning of the firearm 10, and inhibit disassembly of the firearm 10 for repairs or maintenance.

Buffer Assembly

Referring to FIGS. 1-14, the buffer assembly 12 generally includes a cylindrical buffer body 50, a buffer pad 100, a buffer weight 98, and a buffer plug 102. The budder body 50 defines an open rear end 51, a bore or interior space 92 accessible through the open rear end 51, and a threaded hole 94 extending through the front end thereof that is in fluid communication with the interior space 92. The buffer pad 100 is received in the interior space 92 against a forward interior surface of the buffer 50. The buffer weight 98 is received in the interior space 92. The buffer plug 102 is received in and closes the open rear end 51 of the buffer body 50 so that the pad 100 and weight 98 cannot exit the interior space 92 through the open rear end 51.

The buffer assembly 12 can also comprise a locking buffer rod 104 and a timing pin 106 for mounting the buffer weight 98, the buffer pad 100, and buffer plug 102 to the buffer body 50. The timing pin 106 secures the buffer 50, the locking buffer rod 104, and the plug 102 together so that they reciprocate together with one another in time as buffer assembly 12. The locking buffer rod 104 is insertable through each of the buffer weight 98, the buffer pad 100, and buffer plug 102 and threadable into the threaded hole 94. The timing pin 106 is then insertable through corresponding aligned coaxial pin holes 50TP, 102TP, 104TP within each of the body of the buffer body 50, the buffer plug 102, and the locking buffer rod 104 (see FIGS. 4A-4B) to secure the buffer weight 98, the buffer pad 100, and buffer plug 102 to the buffer body 50 and lock the various components together as buffer assembly 12. In this way, coaxially aligned pin holes 50TP, 102TP, 104TP form a timing pin passage in which timing pin 106 is receivable. The locking buffer rod 104 and timing pin 106 can comprise any desired material, such as metal.

The timing pin aperture 104TP in the timing rod 104 is sized to receive the timing pin 106. In some embodiments, the timing pin aperture 104TP is non-circular and generally oval-shaped. In one embodiment, the timing pin aperture 104TP is sized and shaped to allow the locking buffer rod 104 to move axially forward and rearward a small amount (i.e., no more than the length of the threaded forward portion of the locking buffer rod 104) while the timing pin 106 is received in the pin hole 104TP. The benefits of this arrangement are explained below with respect to the buffer locking mechanism 54.

The buffer body 50 also defines an annular protrusion 96 on its exterior circumferential surface. The annular protrusion 96 is sized and shaped to be engaged by the buffer biasing member 52. In the depicted embodiment, the buffer biasing member 52 is a metal compression spring 52 in which the buffer assembly 12 is receivable. Put differently, the buffer assembly 12 is axially receivable inside the coils of the buffer biasing member 52 such that a front end of the biasing member 52 contacts a rear face of the annular protrusion 96. As such, the buffer biasing member 52 is configured to bias the buffer assembly 12 toward the extended position in-battery within the upper receiver 18 and outside of the receiver extension 48.

More specifically, when the buffer assembly 12 and the buffer biasing member 52 are properly installed in an assembled firearm 10, the buffer biasing member 52 biases the buffer assembly 12 forwardly through an opening 34 in the upper receiver 18 toward the extended position (see, e.g., FIGS. 5 and 14) wherein the buffer assembly 12 is in-battery within the upper receiver 18 of the firearm 10. In operation, the buffer assembly 12 reciprocates back and forth within the upper receiver 18 and the receiver extension 48 such that the buffer assembly 12 reciprocates in and out of each of the upper receiver 18 and the receiver extension 48 as the biasing member 52 compresses and decompresses during cycling of the firearm 10. In the retracted position, the buffer assembly 12 and buffer biasing member 52 are completely contained within the receiver extension 48. In some embodiments, the rear end of the buffer plug 102 can contact an interior wall of the rear end of the receiver extension 48 when the buffer assembly 12 is in the retracted position. This minimizes wasted space inside the receiver extension 48 and thereby reduces the overall length of the firearm 10.

Buffer Assembly Locking Mechanism

The buffer assembly 12 can also include a novel buffer assembly locking mechanism 54. The buffer locking mechanism 54 allows a user to quickly and easily lock or secure the buffer assembly 12 and the buffer biasing member 52 in the retracted position (see, e.g., FIGS. 2, 6, and 11) wherein the buffer assembly 12 is completely contained within the receiver extension 48. By "completely contained within" the receiver extension 48, it is meant that no portion of the buffer assembly 12 or the buffer biasing member 52 extends forwardly out of the open forward end of the receiver extension 48 that is engaged with the threaded aperture 63 in the lobe 64 of the lower receiver 16 to impede pivotable movement of the upper receiver 18 relative to the lower receiver 16 about the forward take down pin 26 while the rear take down pin 28 is removed from the upper 18 and lower 16 receivers. Put another way, the rear end of the upper receiver 18 is freely pivotable about the forward take down pin 26 upward and forward relative to the lower receiver 16 (see, e.g., FIG. 14) while the rear takedown pin 28 is removed from the upper 18 and lower 16 receivers and the buffer assembly 12 and buffer biasing member 52 are secured within (and therefore completely contained within) the receiver extension 48 in the retracted position. This function of the buffer assembly locking mechanism 54 not only allows a user to more quickly and easily access the bolt assembly 20 without first disassembling the upper and lower receivers 16, 18, it also makes overall disassembly and reassembly of the firearm 10 much quicker and easier than currently available PDW firearms and compact stocks.

To explain, conventional non-compact AR-style firearms include a spring-loaded buffer retaining pin (not shown) disposed in the threaded aperture 63 of the lower receiver 16 that is arranged to retain the buffer and buffer spring inside a full-size receiver extension housed inside a non-compact stock. However, a conventional buffer retaining pin cannot be used in compact AR-style firearms due to the various size constraints of the platform, including but not limited to the relatively reduced length of compact stock receiver extensions, such as receiver extension 48, which typically require that the buffer reciprocate back and forth between (i.e., in and out of) the upper receiver and the receiver extension (compare, e.g., FIGS. 5A and 6). A standard AR-style buffer retaining pin is therefore not usable in a compact AR-style firearm with a compact stock because such retaining pins prevent the buffer from extending forwardly out of the receiver extension and into the upper receiver to cycle the firearm.

Figure 5A:
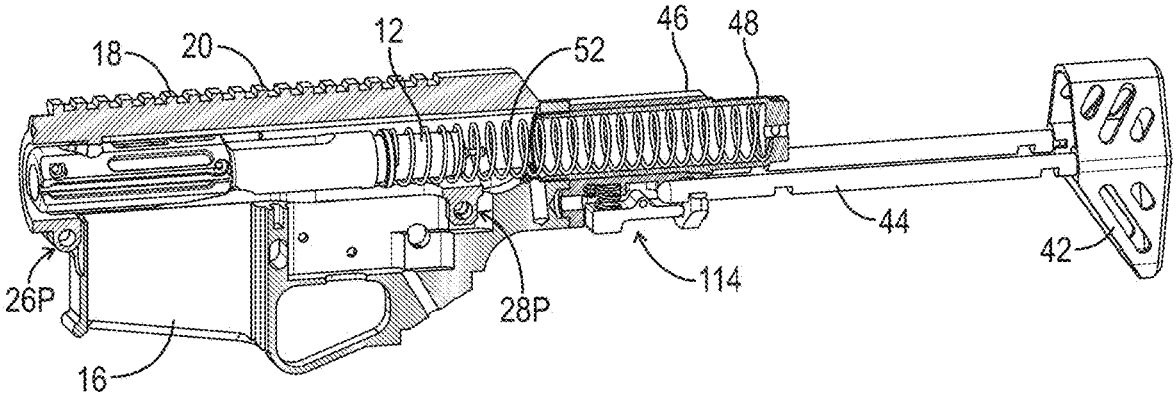
FIG. 5A is a transparent left side elevational view of the firearm of FIG. 1 showing the buffer assembly received and in-battery within the upper receiver. The handle, magazine, and barrel are omitted for clarity.
Figure 5B:
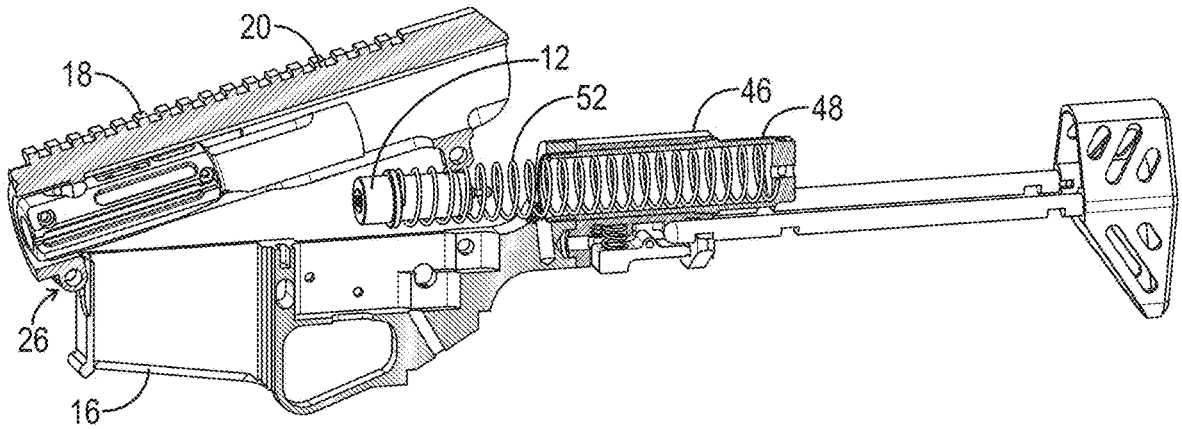
FIG. 5B is another transparent left side elevational view of the firearm of FIG. 5A showing the upper receiver pivoted upward and forwardly about the forward takedown pin relative to the lower receiver in order to illustrate how pivotable movement of the upper receiver is precluded by the buffer assembly and buffer biasing member when the buffer assembly and buffer biasing member are in the extended position.

No known compact AR-style firearms equipped with compact stocks permit rotation of the upper receiver relative to the lower receiver about the forward takedown pin because the buffer spring constantly biases the buffer toward the extended position with the buffer in-battery within the upper receiver and thereby blocks such rotation, as exemplified in FIGS. 5A-5B. To explain, although FIG. 5B shows the upper receiver 18 rotated about forward takedown pin 26 to a desired position, the depiction in FIG. 5B of such rotation is merely aspirational as such rotation is precluded by the presence of the buffer assembly 12 and buffer biasing member 52 in the extended position in-battery within the upper receiver 18 as shown in FIG. 5A. Thus, currently available compact AR-style firearms and compact stocks obligate the user to remove both the forward and rear takedown pins in order to completely remove the upper receiver from the lower receiver before a user can access the bolt assembly or further disassemble the firearm. This process is notoriously cumbersome because the user must remove both of the front and rear takedown pins, move the upper receiver upward and forward to carefully separate them, and simultaneously push rearward on the buffer to compress the buffer spring acting thereon in order to detach the upper receiver from the lower receiver. Reversing the process to reassemble the firearm is even more cumbersome, time-consuming, and frustrating.

The present inventor has solved this problem by providing the buffer assembly locking mechanism 54 described herein. The locking mechanism 54 is configured for releasably and selectably securing the buffer assembly 12 and the buffer biasing member 52 in the retracted position within the receiver extension 48 so that the buffer assembly 12 and the biasing member 52 do not interfere with rotation of the upper receiver 18 about the forward takedown pin 26 during assembly or disassembly of the firearm 10. The locking mechanism 54 can comprise a locking feature 112 that is selectably insertable through the receiver extension 48 to releasably engage the buffer assembly 12 or a part coupled to the buffer body 50 and thereby secure the buffer assembly 12 in the retracted position within the receiver extension 48.

Referring again to FIGS. 1-14, in one embodiment, the buffer locking mechanism 54 can include the locking buffer rod 104 and a locking pin 112. The locking buffer rod 104 is releasably connected to the buffer body 50. The locking buffer rod 104 can be threaded into a threaded hole 94 defined through a forward wall of the buffer body 50 (see FIG. 4). Each of the buffer pad 100, buffer weight 98, and buffer plug 102 can also include a through hole (unnumbered) in which the locking buffer rod 104 is receivable. When the buffer assembly 12 is assembled with the locking buffer rod 104 threaded into the hole 94, the locking buffer rod 104 extends rearwardly through the buffer pad 100, buffer weight 98, and buffer plug 102. A rear end of the locking buffer rod 104 extends rearwardly beyond the buffer plug 102 when the buffer assembly 12 is assembled. The rear end of the locking buffer rod 104 that extends rearwardly beyond the buffer plug 102 when the buffer assembly 12 is assembled defines a rod head 108. The rod head 108 includes an annular groove 110 defined therein. The annular groove 110 defines a mating surface for receiving and engaging locking pin 112. The locking buffer rod 104 may comprise any desired material, such as metal.

Figure 8:
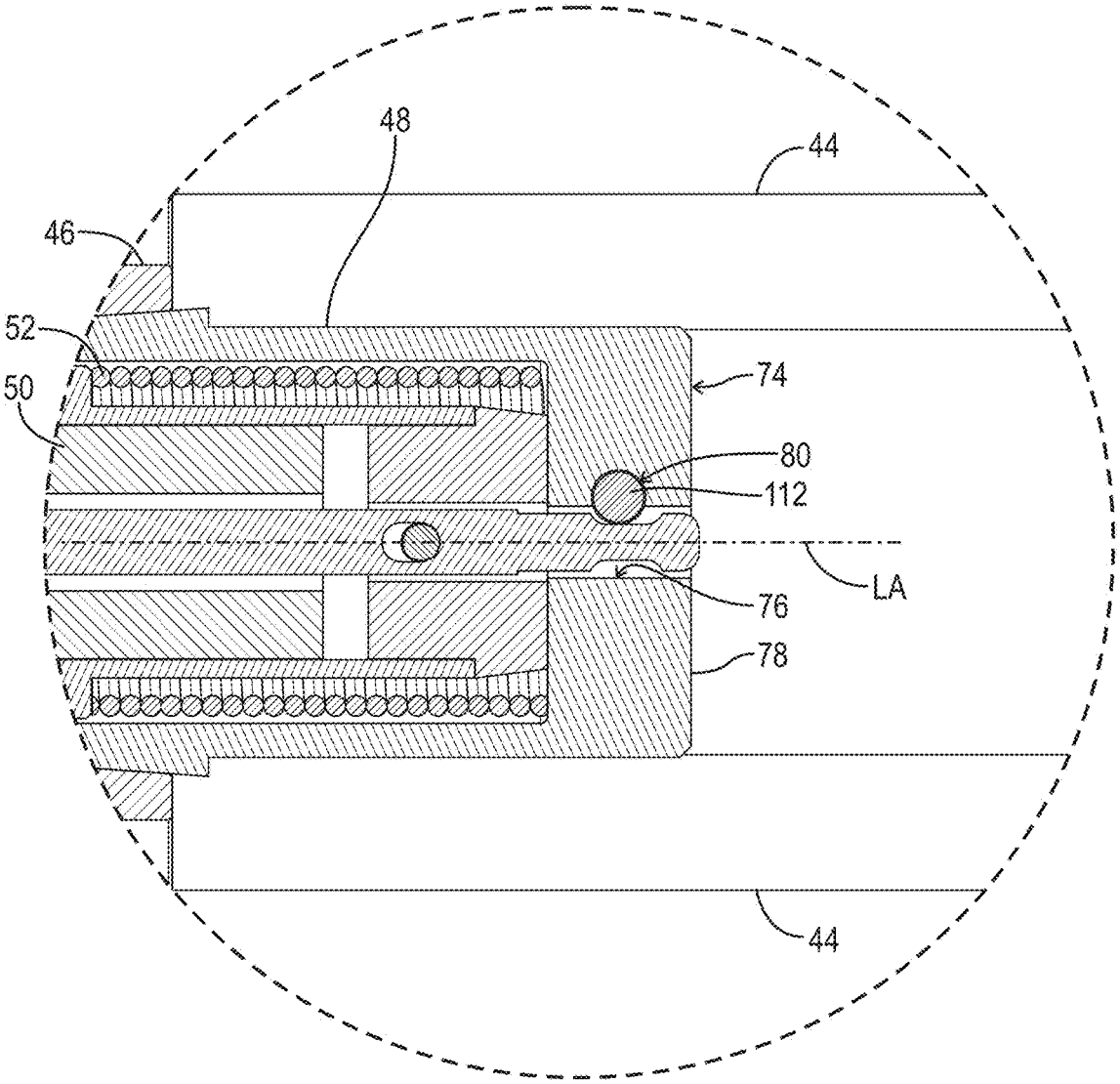
FIG. 8 is an enlarged detail view of the area indicated by circle 8-8 in FIG. 7, showing a top sectional view of the buffer locking mechanism of the compact stock.
Figure 9:
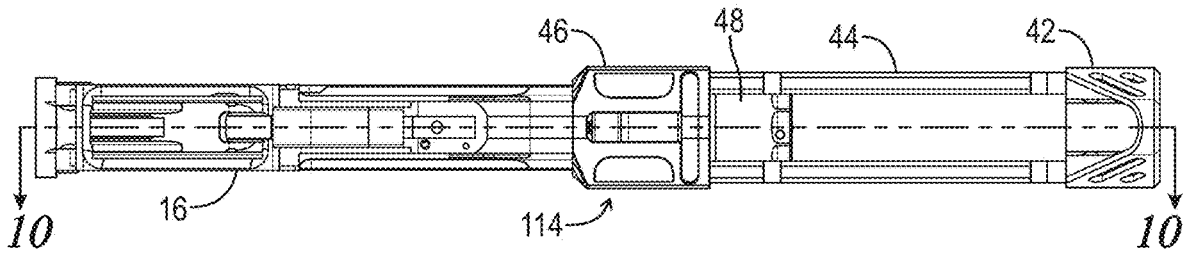
FIG. 9 is a bottom plan view of the firearm of FIG. 6.
Figure 10:
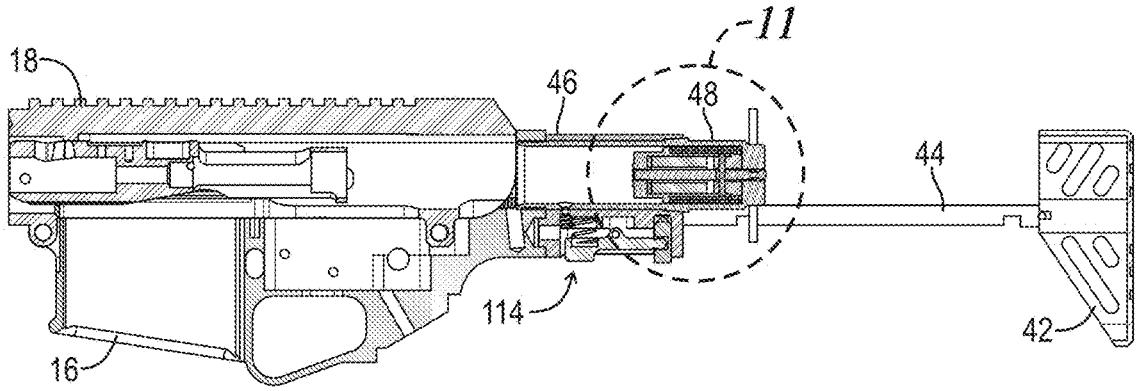
FIG. 10 is a cross-sectional view taken along line 10-10 of FIG. 9.
Figure 11:
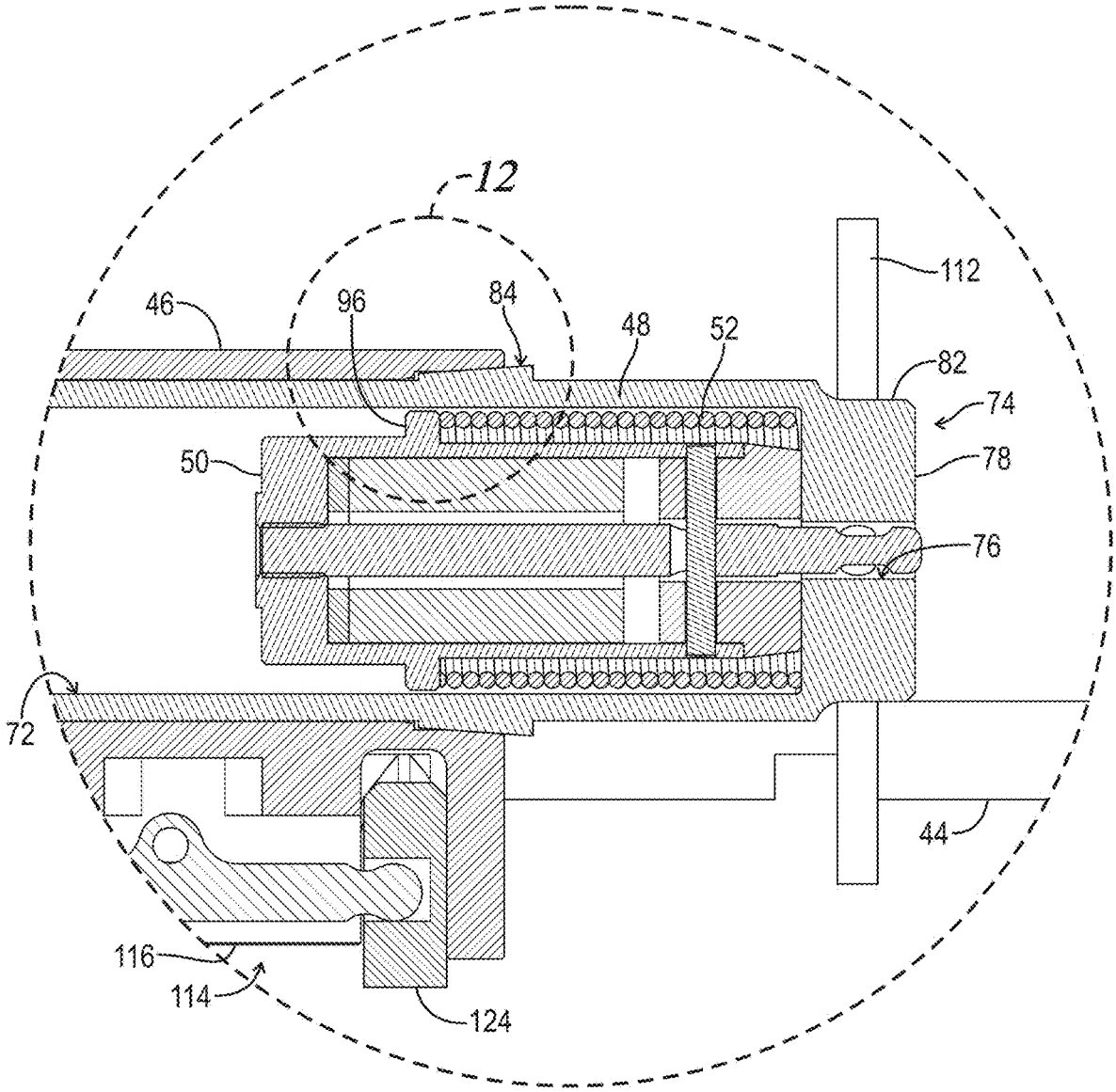
FIG. 11 is an enlarged detail view of the area indicated by circle 11-11 in FIG. 10, showing a left side sectional view of the buffer locking mechanism of the compact stock.

The rear end 74 of the receiver extension 48 includes a primary hole 76 extending longitudinally therethrough. The hole 76 extends longitudinally through the end face 78 of the receiver extension 48 (see FIGS. 3 and 8). The longitudinal hole 76 is coaxial with a longitudinal axis LA of the receiver extension 48 and the buffer bore 92. The primary hole 76 is shaped and sized to receive the rod head 108. The rear end 74 of the receiver extension 48 also includes a secondary hole 80 extending through the receiver extension 48. The secondary hole 80 extends through the rear end of the receiver extension 48 transverse to and off-center from the longitudinal axis LA. The transverse secondary hole 80 intersects the primary longitudinal through hole 76, as best shown in FIGS. 8 and 11. The transverse secondary hole 80 can be located on a side face or flat portion 82 of the hex head of the rear end 74 of the receiver extension 48. The transverse secondary hole 80 is shaped and sized to receive the locking pin 112 therein.

The head 108 of the locking buffer rod 104 is receivable in the primary longitudinal hole 76 of the receiver extension 48 when the buffer assembly 12 is in the retracted position. The buffer assembly 12 can be placed in the retracted position by manually charging the AR-style firearm 10 to compress the buffer biasing member 52. The locking pin 112 is then selectably insertable through the transverse secondary hole 80 and removably receivable in the annular groove 110 of the rod head 108 when the head 108 is received in the primary longitudinal hole 76 of the receiver extension 48 to secure or lock the buffer assembly 12 in the retracted position. More specifically, the locking pin 112 matingly engages the annular groove 110 to prevent the buffer biasing member 52 from biasing the buffer assembly 12 forwardly out of the receiver extension 48 and into the upper receiver 18 of the firearm 10 when the rod head 108 is received in the primary longitudinal hole 76 and the locking pin 112 is received in the transverse secondary hole 80 and annular groove. The locking pin 112 need not be fixedly attached to the firearm 10. The locking pin 112 can be removably attached to the stock 24 or other member of the firearm 10.

Figure 6:
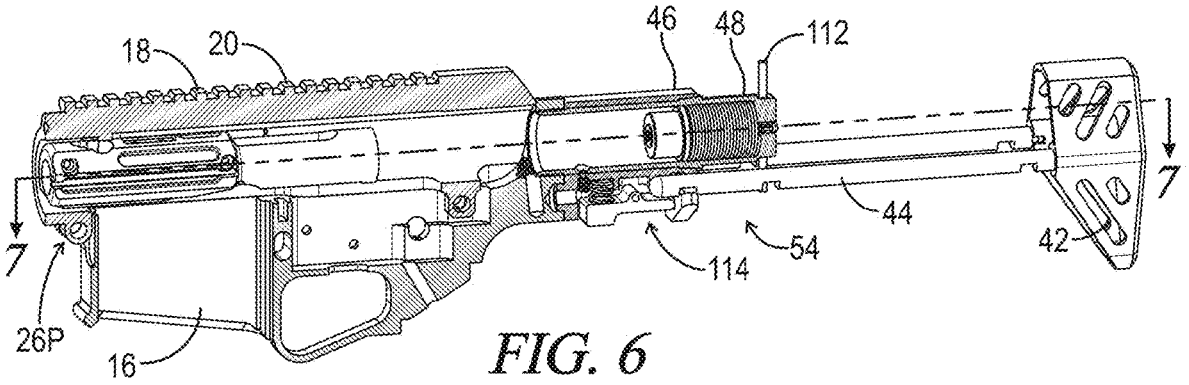
FIG. 6 is a transparent left side elevational view of the firearm of FIG. 5A showing the buffer assembly secured in a retracted position such that the buffer assembly is contained entirely within the receiver extension.
Figure 7:
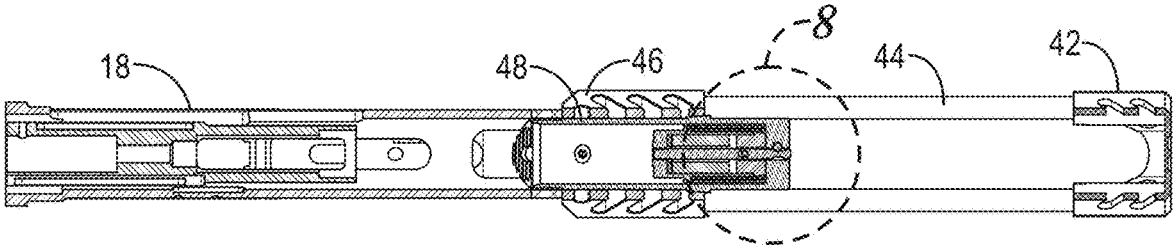
FIG. 7 is a cross-sectional view taken along line 7-7 of FIG. 6.

As a result of the buffer assembly 12 and buffer biasing member 52 being completely contained and secured within the receiver extension 48 by locking pin 112 as shown in FIG. 6, the upper receiver 18 is free to pivot about the forward takedown pin 26 (when the rear takedown pin 28 is removed) unimpeded by the buffer assembly 12 and the buffer biasing member 52. Additionally, when the buffer assembly 12 is secured in the retracted position, the buffer rod head 108 rests in the primary longitudinal hole 76, which can be an indicator hole 76, at the rear portion 74 of the receiver extension 48. This provides a visual indicator that the buffer assembly 12 and the buffer biasing member 52 are secured in the retracted position within the receiver extension 48.

A user may "tune" both how far the rod 104 protrudes from the receiver extension 48 and how tightly or loosely the locking pin 112 is retained in the annular groove 110 and transverse secondary hole 80 by threading the front end of the locking buffer rod 104 further into the threaded hole 94 in the forward wall of the buffer body 50. To explain, threading the rod 104 further into the buffer body 50 translates the annular groove 110 forward relative to the transverse secondary hole 80, whereas threading the rod 104 rearwardly out of the buffer body 50 (i.e., backing the rod 104 out of hole 94) translates the annular groove 110 rearward relative to the transverse secondary hole 80. In this way, a user can select both (i) how far the head 108 of the rod 104 protrudes rearwardly out of the primary longitudinal hole 76 in the rear of the receiver extension 48 while the buffer assembly 12 is in the retracted position, and (ii) how closely the annular groove 110 aligns with transverse secondary hole 80.

To release the buffer assembly 12 from the retracted position, a user need only withdraw the locking pin 112 from the transverse secondary hole 80 of the receiver extension 48. This causes the locking pin 112 to disengage from the mating surface of the annular groove 110 in the locking buffer rod 104, which in turn allows the buffer biasing member 52 to return the buffer assembly 12 to the forward extended in-battery position within the upper receiver 18 of the firearm 10.

Referring now to FIGS. 15-18, in another embodiment, the locking mechanism 54 can comprise a lever action locking stopper mechanism 114 connected to the housing 46 of the compact stock 24. The lever action locking stopper mechanism 114 comprises a lever 116 pivotably connected to the housing 46 via a pivot pin, a lever biasing member 118 disposed between a forward end of the lever 116 and the housing 46, a locking pin 120 adjacent to the forward end of the lever 116, a pin biasing member 122 disposed between the housing 46 and the locking pin 120, and a pin hole 125 defined though a sidewall of the receiver extension 48. Locking pin 120 differs in form from locking pin 112 in that locking pin 120 includes a conical head 121 and a flange 123 spaced from the head 121. The conical head 121 is configured to interface with the annular protrusion 96 on the buffer body 50. The flange 123 of the locking pin 120 is configured to interface with the pin biasing member 122, which can be a compression spring 122. A depression 127 in which the pin head 121 is receivable is formed on an interior surface of the receiver extension 48 around the pin hole 125. The surface of the receiver extension 48 on which the depression 127 is formed is a surface of the bore 72 of the receiver extension. The head 121 of the locking pin 120 is received inside the bore 76 of the receiver extension 48. The shaft of the locking pin extends through the pin hole 125 such that the flange 123 sits outside the receiver extension 48. The pin biasing member 122 is disposed around the shaft of the locking pin 120 between the housing 46 and the flange 123. The pin biasing member 122 biases the locking pin 120 toward a retracted position wherein the locking pin head 121 is received in the depression 127 such that the head 121 sits flush with the interior surface of the receiver extension 48.

The locking pin 120 is extendable through the pin hole 125 into the receiver extension 48 by depressing the portion of the lever 116 which rests adjacent the locking pin 120. Depressing the portion of lever 116 adjacent the locking pin 120 causes the lever 116 to contact the locking pin 120. This moves the locking pin 120 upward, causing the flange 123 to compress the biasing member 122 against housing 46 and move the locking pin 120 upward and further into the interior of the receiver extension 48. Movement of the locking pin 120 further into the interior of the receiver extension 48 while the buffer assembly 12 is being held in the retracted position (e.g., while the firearm 10 is charged by manually pulling a charging handle thereof rearward) places the locking pin head 121 axially in front of the annular protrusion 96 on the buffer body 50. With the locking pin head 121 in front of the annular protrusion 96 on the buffer body 50, a user may cease charging the firearm (e.g., by releasing the charging handle). The buffer biasing member 52 will then attempt to decompress and bias the buffer assembly 12 forward. This biases the annular protrusion 96 on the buffer body 50 into contact with the locking pin head 121. Contact with the locking pin head 121 automatically halts further forward movement of the buffer assembly 12, and thereby automatically secures or locks the buffer assembly 12 in the retracted position within the receiver extension 48. This allows the user to then remove the rearward takedown pin 28 and freely pivot the upper receiver 18 about the forward take down pin 26 of the firearm 10 to access the bolt assembly 20 or disassembly the firearm 10. In this way, the locking pin 120 function as a stopper which contacts the front of the annular protrusion 96 and holds the buffer assembly 12 in the retracted position. The size and shape of the head 121 of the locking pin 120 can correspond to the size and shape of the annular protrusion 96 of the buffer body 50. For example, the annular protrusion 96 can define a recess or groove 127 on a forward surface thereof that is complimentary in shape to the conical head 121 of the locking pin 120, as exemplified in FIGS. 17-18.

Recoil Damping System

Referring now to FIGS. 1, 3, and 19-20, the compact stock 24 further includes a recoil damping system 130. The recoil damping system 130 is configured to dampen the recoil of the AR-style firearm 10 felt by a user upon discharge of the firearm. The recoil damping system 130 includes the butt member 42, the pair of buttstock rods 44, the pair of fasteners 132, and the pair of rod biasing members 134.

As noted above, the rods 44 are adjustably connected to the housing 46 via the rod through holes 56 in the housing 46 and the stock locking member 124. The butt member 42 is removably connected to the rods 44 by the pair of fasteners 132. In the depicted embodiment, each fastener 132 is a metal shoulder screw having a head and a narrower shaft with a smooth portion adjacent the head and a threaded portion adjacent the smooth portion, while each biasing member 134 is a metal compression spring.

The butt member 42 is a skeletonized buttstock (see FIG. 1) configured for contacting the shoulder of a user and stabilizing the firearm 10 during discharge. A pair of laterally spaced, left and right fastener bores 140 are defined in a rear face of the butt member 42. The fastener bores 140 are smooth and sized to receive the head of each fastener 132. The butt member 42 includes a pair of laterally spaced, left and right tubular rod receiving members 136 which extend forwardly from an interior surface of the butt member 42. Each rod receiving member 136 defines a smooth rod bore 138 therein in which a rod biasing member 134 and a rod 44 is receivable. The rod bores 138 have a diameter which facilitates smooth insertion and axial reciprocation of the rods 44 therein without appreciable lateral movement or "wobble" of the rods 44 in the rod receiving members 136. Each rod receiving member 136 also defines a flat interior wall 133 in each rod bore 138. Each flat interior wall 133 defines a rear end of the respective rod bore 138 and a front end of each respective fastener bore 140. A smooth fastener access hole 142 for receiving the shaft of a fastener 132 therethrough is defined through each interior wall 133. The left rod bore 138, left fastener access hole 142, and left fastener bore 140 are all coaxially aligned. Likewise, the right rod bore 138, right fastener access hole 142, and right fastener bore 140 are all coaxially aligned.

The rod biasing members 134 are received in the rod bores 138 of the rod receiving members 136 against the interior wall 133. The rear ends of the rods 44 are received in the rod bores 138 against the rod biasing members 134. The heads of the fasteners 132 are received in the fastener bores 140 such that the smooth portions of the shafts of the fasteners 132 extend through the fastener access holes 142 in the interior walls 133, through the rod biasing members 134, and into the rod bores 138. The rod biasing members 134 are thus disposed around the fasteners 132 with the rear ends of the biasing members 134 contacting the flat interior walls 133 of the rod bores 138 and the forward ends the biasing members 134 contacting the rear ends of the rods 44. The threaded portions of the fasteners 132 are received in and threadingly engaged with threaded bores 144 formed in the rear ends of the rods 44. In this way, each fastener 132 removably connects the butt member 42 to a respective buttstock rod 44.

In some embodiments, the diameter of the rod bores 138 differs from the diameter of the fastener bores 140 and the diameter of the fastener access holes 142. In other embodiments, the diameters of the rod bores 138 and fastener bores 140 can be the same, while the diameter of the fastener access holes 142 differs from the diameters of the rod bores 138 and fastener bores 140. What matters is that the interior walls 133 partition the rod bores 138 from the fastener bores 140 such that the heads of the fasteners 132 remain in the fastener bores 140 while the rods 44 and rod biasing members 134 remain in the rod bores 138. Consequently, the fastener access holes 142 should have a diameter smaller than the diameters of the fastener heads 132, rods 44, and rod biasing members 134.

In use, the rearward recoil force generated upon discharge of the firearm 10 moves the firearm 10 and the connected rods 44 rearwardly, which causes the rods 44 to compress the biasing members 134 inside the butt member 42 against the interior walls 133. The fasteners 132 translate rearwardly with the rods 44. However, the fasteners 132 do not exit the fastener bores 140 because the fastener bores 140 are sized so to be at least as long as the portion of the fastener shaft extending between the rear end of the rods 44 and the forward face of the interior wall 133 (see FIG. 22). In other words, the fastener bores 140 are at least as long as the distance the rods 44 travel rearwardly in the rod bores 138 upon discharge. The rod biasing members 134 are configured to oppose axial compression and bias the rods 44 forwardly away from the interior walls 133 of the butt member 42 in opposition to the rearward recoil force. The pair of rod biasing members 134 thus oppose rearward translation of the rods 44 in the rod bores 138, and thereby dampen the recoil felt by a user upon discharge of the firearm 10.

Although embodiments of the present invention have been described in detail, it will be understood by those skilled in the art that various modifications can be made therein without departing from the spirit and scope of the invention as set forth in the appended claims. For example, the buffer assembly locking mechanism 54 can include either or both of the removable locking pin 112 and the lever-action stopper locking mechanism 114. Additionally, although the rod biasing members 134 are described above as being metal compression springs, other suitable structures made from other suitable materials are contemplated herein and covered by the claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A compact stock for an AR-style firearm, comprising:

a housing configured to be secured to a lower receiver of the firearm;

a butt member defining a pair of rod bores therein;

a pair of rod biasing members disposed within the pair of rod bores;

a pair of rods extending from the housing into the pair of rod bores and against the pair of rod biasing members; and a pair of fasteners configured to connect the pair of rods to the butt member and retain the pair of rods in the pair of rod bores;

wherein the pair of rod biasing members are configured to oppose rearward movement of the rods during discharge of the firearm and thereby damp the recoil of the firearm.

2. The compact stock of claim 1, wherein:

the butt member includes a pair of interior walls which partially obstruct the pair of rod bores; and the pair of rod biasing members are disposed in the rod bores against the pair of interior walls and act against the interior wall and an end of each rod to oppose compression caused by rearward movement of the rods during discharge of the firearm.

3. The compact stock of claim 2, wherein:

each rod of the pair of rods includes a threaded bore defined in a rear end thereof;

each interior wall of the pair of interior walls includes an access hole defined therethrough; and each fastener is a threaded fastener configured to extend through the access hole of the respective interior wall and into the threaded bore of the respective rod to threadingly engage the rod and thereby retain the rod in the respective rod bore of the butt member.

* * * * *